US006299476B1

(12) United States Patent
Schramme et al.

(10) Patent No.: US 6,299,476 B1
(45) Date of Patent: Oct. 9, 2001

(54) ELECTRICAL CONNECTOR WITH A FLEXIBLE CIRCUIT AND RIGIDIZER SUBASSEMBLY AND A SPRING

(75) Inventors: Stephan H. Schramme, Canton; David J. Goetzinger, Livonia, both of MI (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/678,957

(22) Filed: Oct. 4, 2000

(51) Int. Cl.[7] ..... H01R 12/24
(52) U.S. Cl. ..... 439/496; 439/492
(58) Field of Search ..... 439/492, 493, 439/495, 496, 499

(56) References Cited

U.S. PATENT DOCUMENTS

| | | | | |
|---|---|---|---|---|
| 3,082,398 | * | 3/1963 | Valach | 439/496 |
| 3,114,587 | * | 12/1963 | Hermann | 439/329 |
| 3,897,130 | * | 7/1975 | Donnelly et al. | 439/496 |
| 4,971,575 | * | 11/1990 | Martellotti | 439/496 |
| 5,620,329 | | 4/1997 | Kidd et al. | 439/248 |
| 6,074,220 | * | 6/2000 | Roberts | 439/67 |

FOREIGN PATENT DOCUMENTS

| | | |
|---|---|---|
| 0889547 | 1/1999 | (EP) . |
| 0908968 | 4/1999 | (EP) . |
| 0908975 | 4/1999 | (EP) . |
| 0945927 | 9/1999 | (EP) . |
| WO 97/33343 | 9/1997 | (WO) . |

* cited by examiner

*Primary Examiner*—Tulsidas Patel
(74) *Attorney, Agent, or Firm*—Perman & Green, LLP

(57) ABSTRACT

An electrical connector comprising a housing; a flexible circuit and rigidizer subassembly located in the housing; and a spring located in the housing and contacting a first side of the subassembly. A second opposite side of the subassembly comprises an electrically conductive area. The spring biases the subassembly in a direction of the second opposite side. The spring is not electrically connected to the electrically conductive area.

22 Claims, 10 Drawing Sheets

ELECTRICAL CONNECTOR WITH A FLEXIBLE CIRCUIT AND RIGIDIZER SUBASSEMBLY AND A SPRING

BACKGROUND OF THE INVENTION

1. Field of the Invention

The present invention relates to electrical connectors and, more particularly, to an assembly comprising a flexible circuit and rigidizer subassembly and a spring.

2. Prior Art

European Patent Office application No. 0908968 discloses a female electrical connector having a flexible circuit on a U-shaped female housing and a box-like outer shell. U.S. Pat. 5,620,329 discloses a flexible circuit mounted on a support for insertion into a mating electrical connector. There is a need for a flexible circuit connector which can align the flexible circuit relative to the housing of the connector and which can bias contact areas of the flexible circuit against an electrical contact or another electrical assembly.

SUMMARY OF THE INVENTION

In accordance with one embodiment of the present invention an electrical connector is provided comprising a housing; a flexible circuit and rigidizer subassembly located in the housing; and a spring located in the housing and contacting a first side of the subassembly. A second opposite side of the subassembly comprises an electrically conductive area. The spring biases the subassembly in a direction of the second opposite side. The spring is not electrically connected to the electrically conductive area.

In accordance with another embodiment of the present invention, an electrical connector is provided comprising a housing; a first flexible circuit and rigidizer subassembly located in the housing; and a first spring member located between the housing and the subassembly. The spring member contacts opposite lateral sides of the subassembly to thereby align the subassembly in the housing.

In accordance with another embodiment of the present invention, an electrical connector is provided comprising a housing; a flexible circuit and rigidizer subassembly located in the housing; and a spring member located between the housing and the subassembly. The spring member is connected to the housing and comprises locking sections which contact opposite lateral sides of the subassembly to thereby retain the subassembly in the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
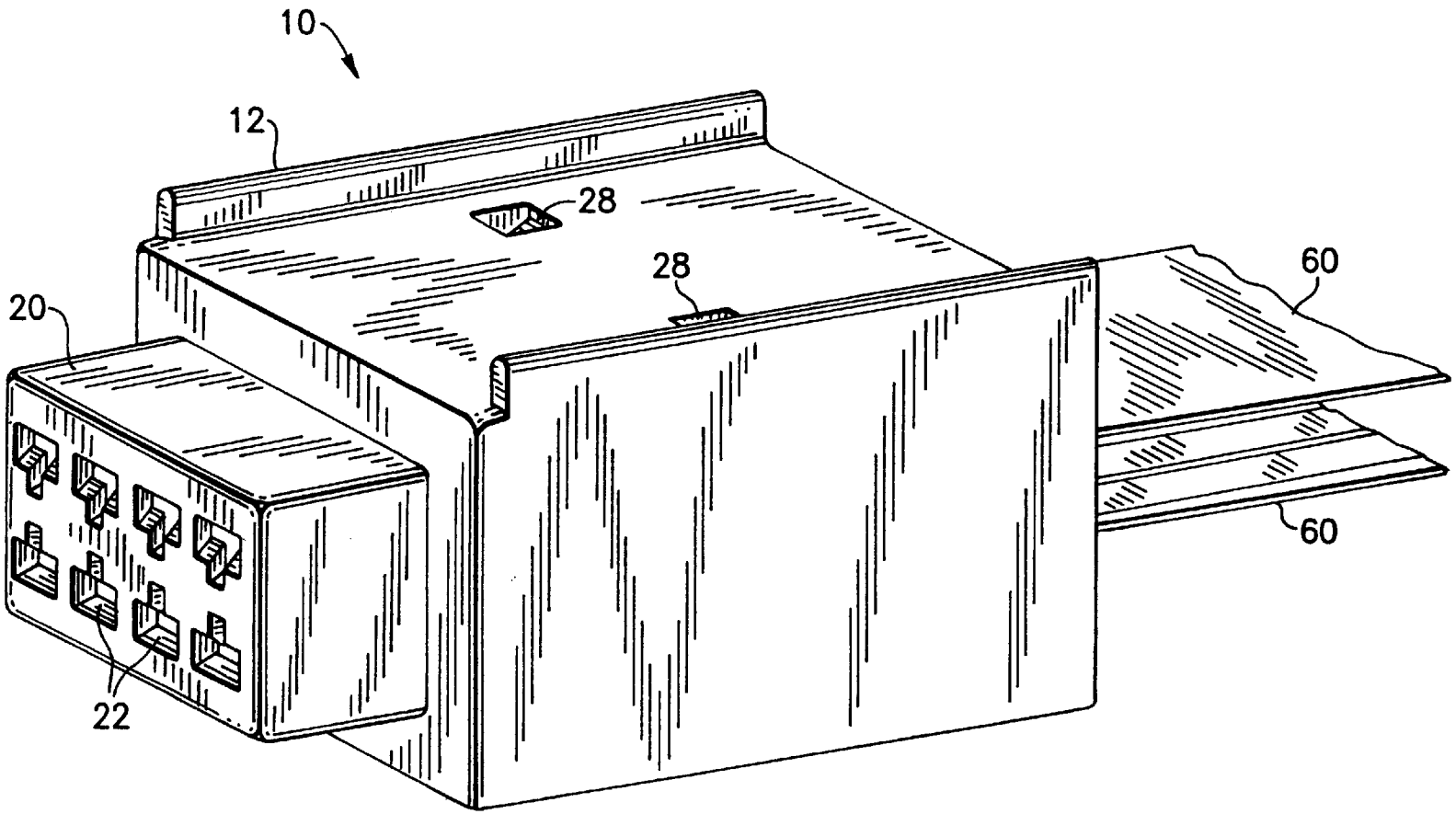
FIG. 1 is a perspective view of an electrical connector and flexible circuit assembly incorporating features of the present invention.

Referring to FIG. 1, there is shown a perspective view of an electrical connector and flexible circuit assembly 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Figure 2:
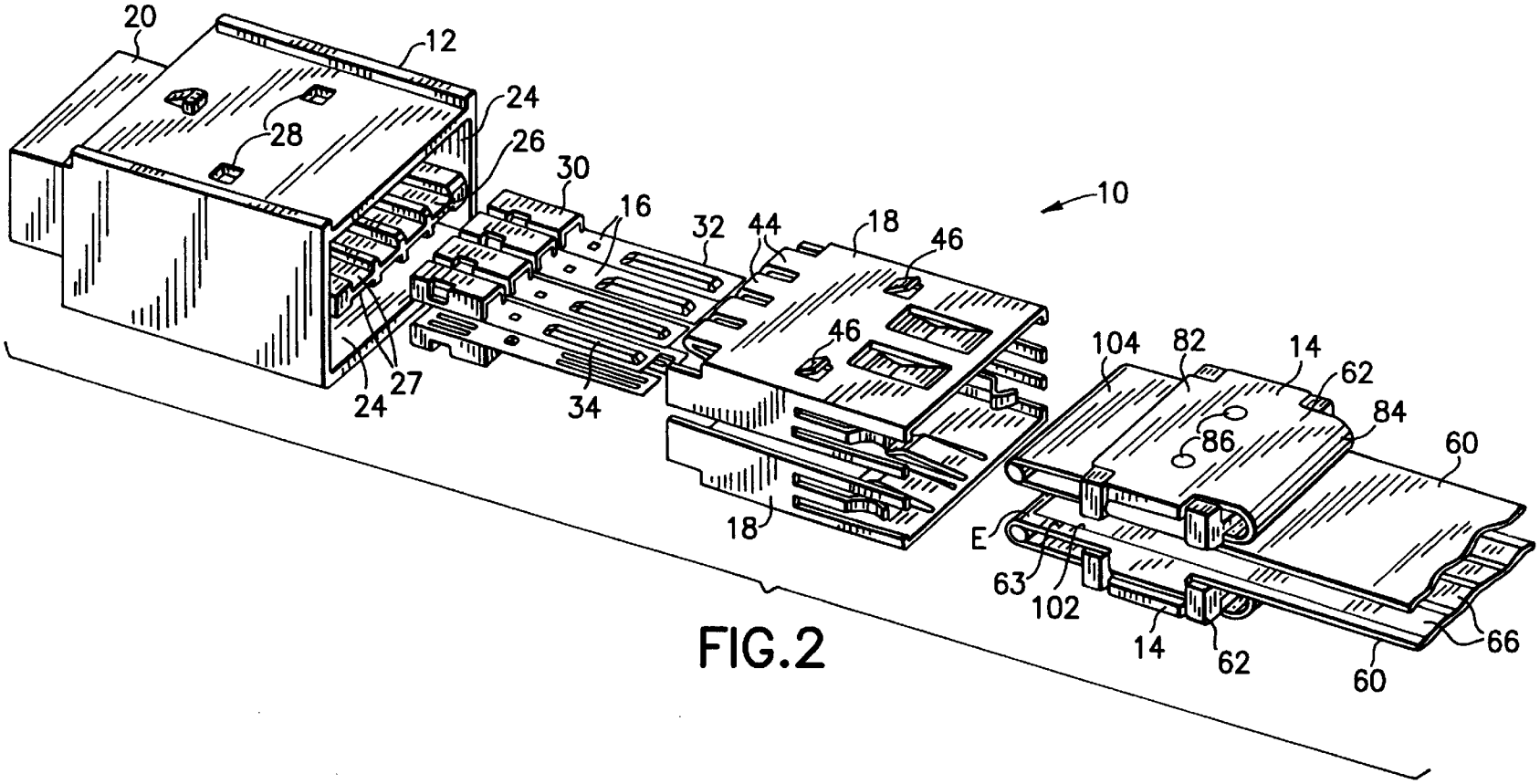
FIG. 2 is an exploded perspective view of the assembly shown in FIG. 1.
Figure 3:
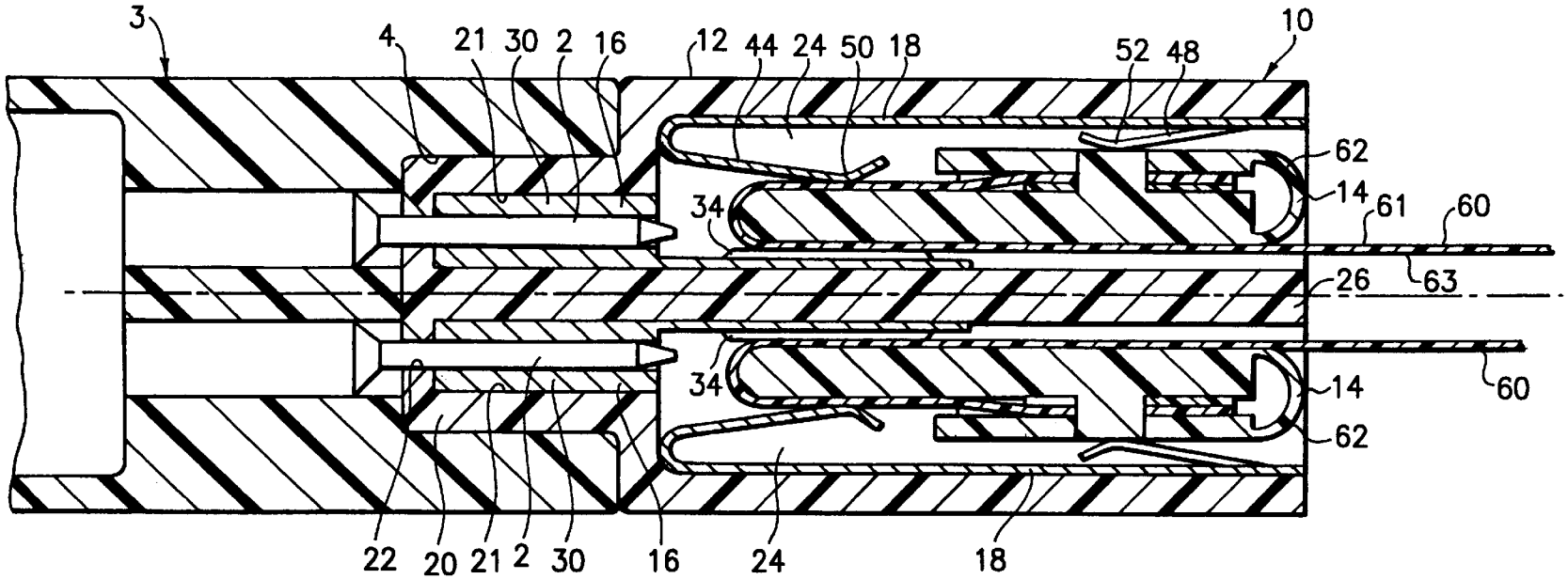
FIG. 3 is a cross-sectional view of the assembly shown in FIG. 1 connected to a mating electrical connector.

Referring also to FIGS. 2 and 3, the assembly 10 generally comprises a housing 12, two flexible circuit and support subassemblies 14, electrical contacts 16, and spring members 18. The housing 12 is preferably a one piece member comprised of molded plastic or polymer material. However, any suitable material(s) or numbers of members could be used. The housing 12 has a front end 20 with apertures 22 adapted to receive male sections 2 of contacts from a mating electrical connector 3. The front end 20 is sized and shaped to be inserted into a receiving area 4 of the mating electrical connector. The housing 12 has two interior receiving areas 24 separated by a separator wall 26 and having open rear ends. The separator wall 26 includes recesses 27 for the contacts 16 on its top and bottom sides. The front end 20 has pockets 21 for the front ends 30 of the contacts 16 at the apertures 22. The housing 12 also has latch receiving areas 28 in its top and bottom walls.

The contacts 16 each comprise a female section at its front end 30 and a tail 32. In this embodiment the connector has eight of the contacts 16 arranged in two rows of four each. However, any suitable number of contacts or arrangement could be provided. The front end female sections 30 are adapted to make a removable electrical connection with the male sections 2 when the male sections are inserted through the apertures 22. The tails 32 lie against the separator wall 26 in the contact recesses 27. The tails 32 include raised contact ridges 34. However, in alternate embodiments any suitable type of contacts could be provided.

Figure 7:
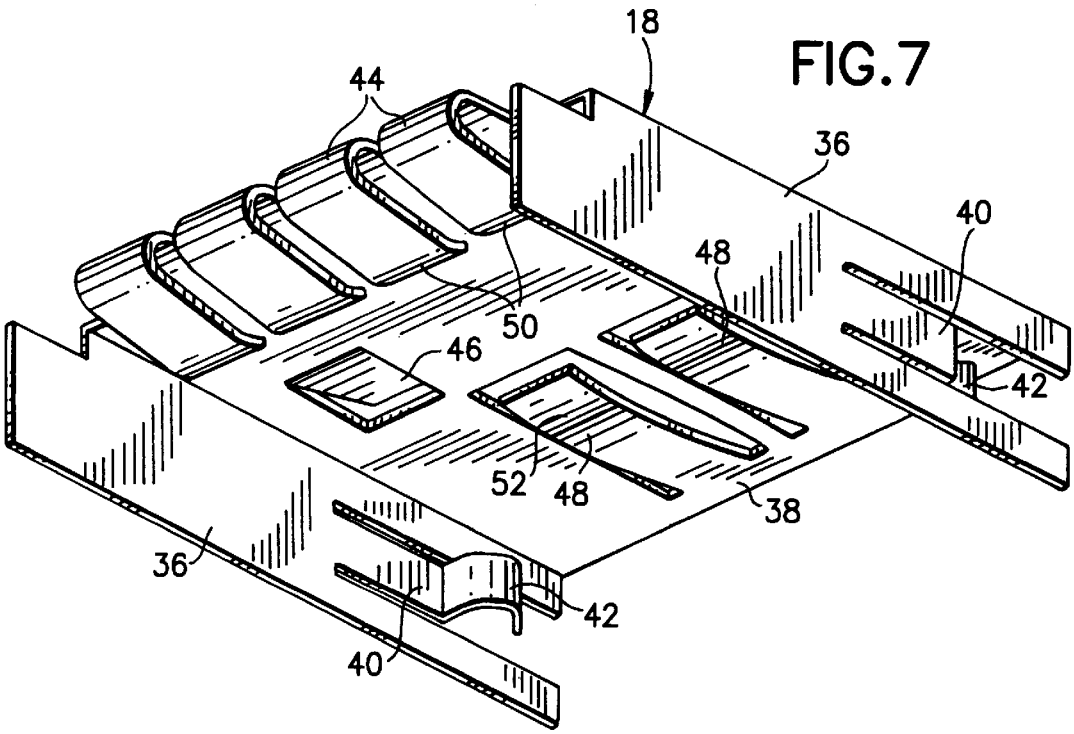
FIG. 7 is a perspective view of one of the spring members shown in FIGS. 2 and 3.

Referring also to FIG. 7, the spring members 18 generally comprise a one-piece metal member. However, any suitable type of material(s) or number of pieces could be used. In this embodiment the assembly 10 has two of the spring members, but more or less than two spring members could be provided. In this embodiment the two spring members 18 are the same, but merely oriented in opposite orientations. In alternate embodiments the spring members could have different shapes. Each spring member 18 generally comprises two opposite lateral sides 36 connected by a main section 38. The sides 36 have spring sections 40, which comprise resiliently deflectable cantilevered arms having inward extensions 42 at their rear ends. The main section 38 includes front end spring fingers 44, housing engagement latches 46, and spring sections 48. The latches 46 engage the latch receiving areas 28 of the housing 12 to fixedly mount the spring members 18 in the interior receiving areas 24 of the housing 12. The sides 36 can rest against the separator wall 26. The front end spring fingers 44 extend in a forward direction in a general cantilever fashion and bend back in a rearward and inward direction. The fingers 44 are separately resiliently deflectable relative to each other. Ends of the fingers 44 include curves 50. The spring sections 48 extend inward from the main section 38 and also include ends with curves 52.

Figure 4A:
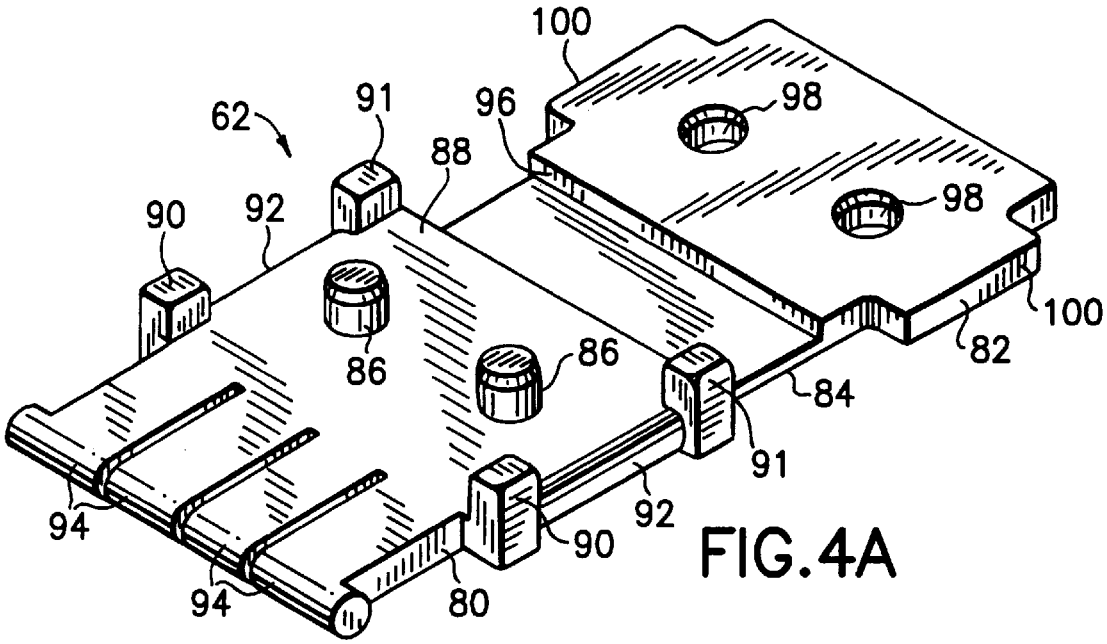
FIGS. 4A and 4B are perspective views of two different types of flexible circuit supports which can be used in the assembly shown in FIGS. 1–3.
Figure 5A:
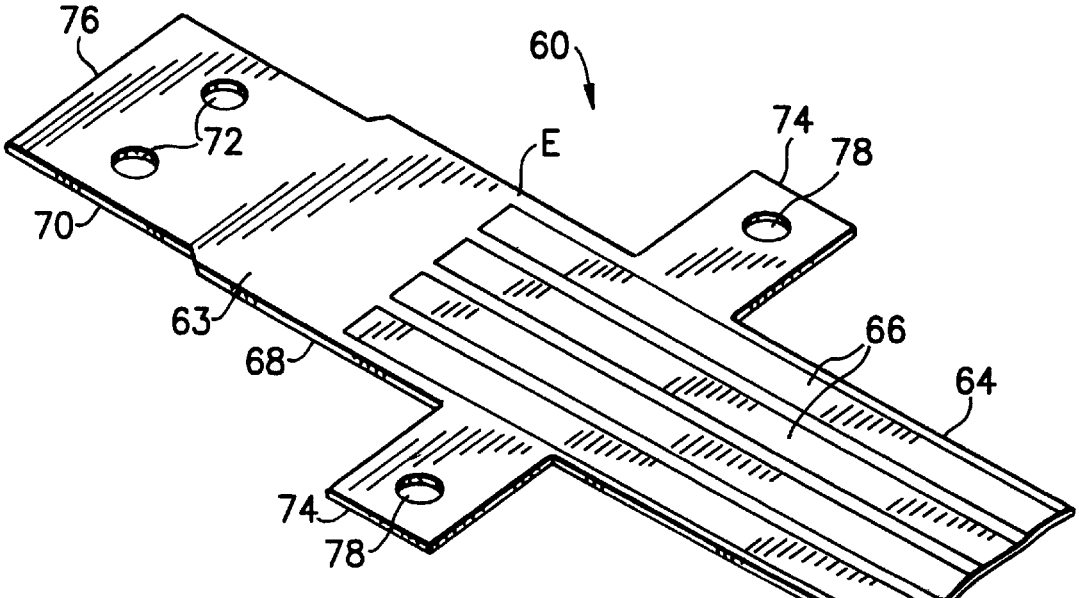
FIGS. 5A and 5B are perspective views of a portion of two different types of the flexible circuits shown in FIGS. 1–3.

Referring now to FIGS. 2, 3, 4A and 5A, the flexible circuit and support subassemblies 14 generally comprise a flexible circuit 60 and a support or rigidizer 62. In this embodiment the assembly 10 has two of the subassemblies. In alternate embodiments the assembly could have more or less than two subassemblies. The flexible circuit includes a flexible substrate 64 and flexible electrical conductors 66 on the substrate 64. FIG. 5A shows one end 68 of the flexible circuit 60 with the conductors 66 exposed. The conductors 66 are preferably covered along the length of the flexible circuit except at its ends. The substrate 64, in this embodiment, includes a front end 70 with two first mounting holes 72 and two flaps 74 extending from opposite lateral sides of the substrate. The flaps 74 are set back from an end edge 76 of the flexible circuit 60. Each flap 74 includes a second mounting hole 78. The conductors 66 are exposed on one side 63 of the substrate 64 and end at a location E spaced from the end edge 76, but past the flaps 74. In this embodiment the flexible circuit has four conductors. However, any suitable number could be provided.

The support or rigidizer 62, as best seen in FIG. 4A, comprises a one-piece member made of molded plastic or polymer material. However, any suitable material(s) could be used and the support could be comprised of an assembly of multiple members. The support 62 generally comprises a first section 80, a second section 82, and a living hinge 84 connecting the second section to the first section. The first section 80 generally comprises holding structure elements or posts 86 extending from a side 88, front and rear lateral side projections 90, 91, curved or rounded edge portions 92 on lateral sides between the projections 90, 91, and cantilevered fingers 94 projecting in a forward direction. The fingers 94 are separately resiliently deflectable. The hinge 84 extends from the rear end of the first section 80. A front end 96 of the second section 82 is connected to the hinge 84. The second section 82 includes holding structure elements or holes 98 and projections 100 on opposite lateral sides of the second section. In alternate embodiments any suitably type of mateable holding structure elements could be provided. In addition, the first and second members could be connected to each other by any suitable type of movable connection or could be separate from each other until mated with each other. The first and second sections could also have any suitable size, shape or features.

Figure 4B:
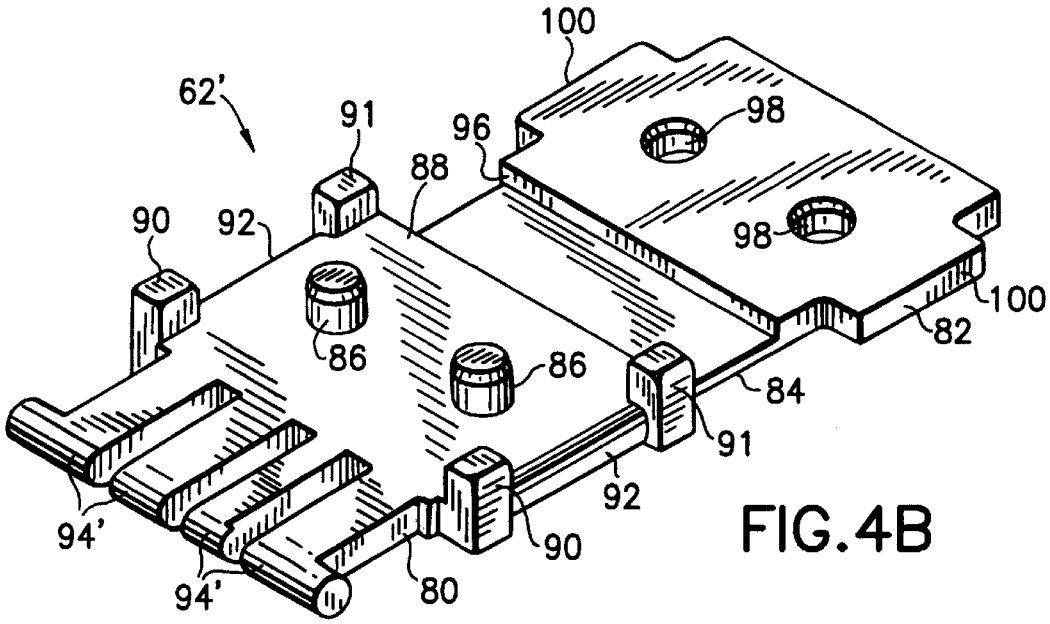

FIG. 4B shows an alternate embodiment of the rigidizer 62' which is substantially the same as the rigidizer 62 shown in FIG. 4A except at the front of the first section 80. In this embodiment, the fingers 94' have a narrower cross-section at the joint with the rest of the first section. This is provided in order to increase flexibility of the fingers 94'. In alternate embodiments, any suitable means could be used to increase flexibility of the fingers.

Figure 5B:
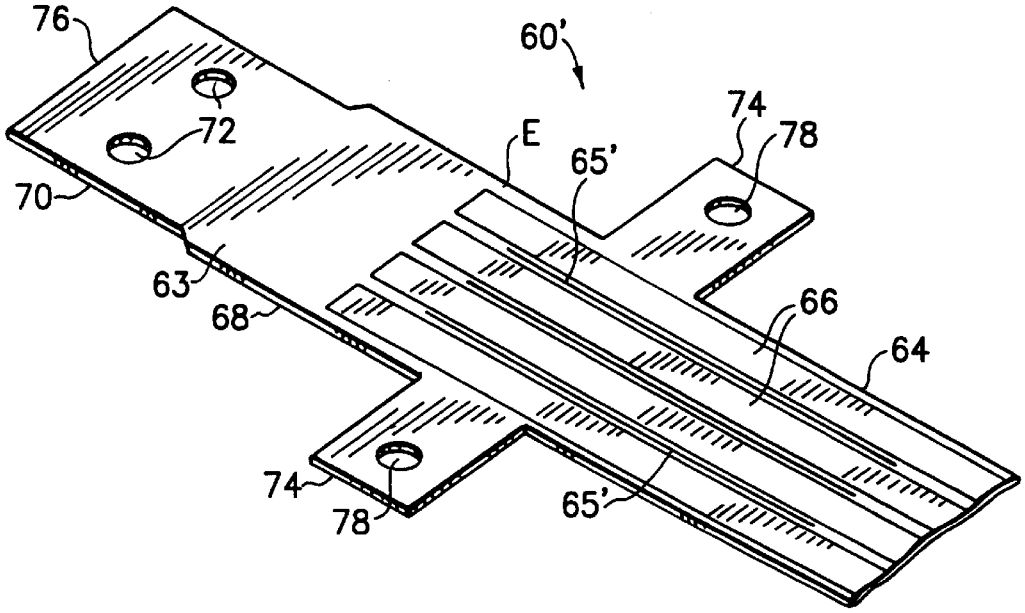

FIG. 5B shows an alternate embodiment of the flexible circuit 60' which is substantially the same as the flexible circuit 60 shown in FIG. 4A. In this embodiment, the substrate 64 includes slits 65'. The slits 65' are located between the conductors 66 allowing greater mobility of the conductors relative to each other at the slits 65'. In another alternate embodiment the flexible circuit could have a ground plane electrical contact trace on the substrate on an opposite side of the substrate from the signal contact traces 66. The ground contact trace could be electrically contacted by the spring or the support 62 if the support has an electrically conductive section. In other alternate embodiments, any suitable combination or orientation of ground and signal contact traces or areas on the flexible circuit could be provided.

Figure 6:
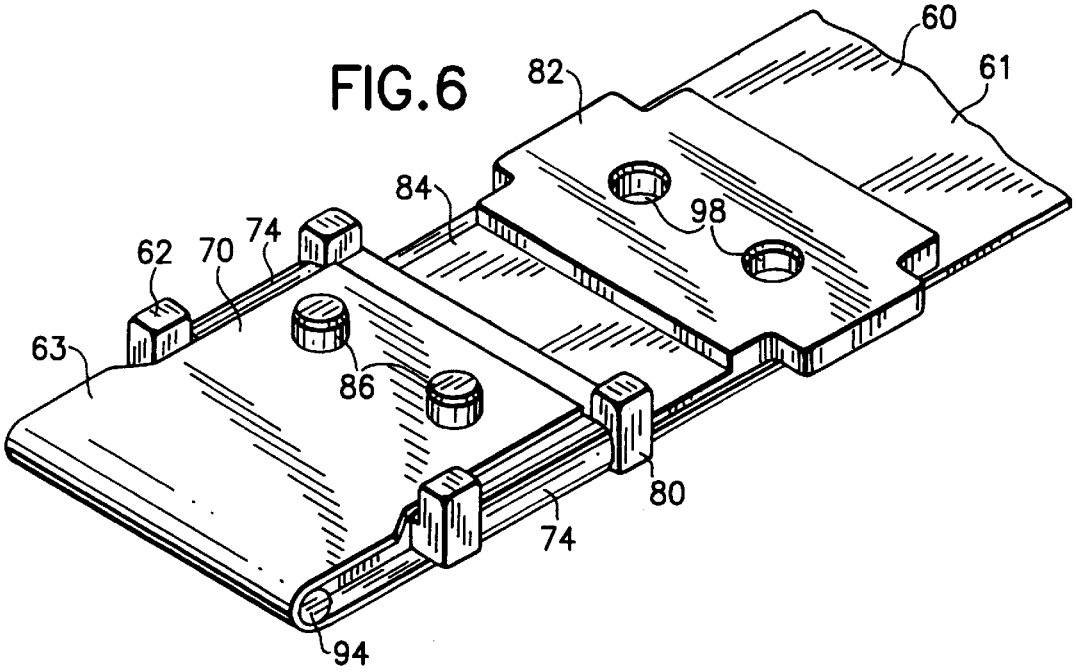
FIG. 6 is a perspective view of the support shown in FIG. 4A having the end of the flexible circuit shown in FIG. 5A mounted thereon.

Referring also to FIG. 6, the flexible circuit 60 and the support 62 are shown partially assembled. The side 61 of the flexible circuit 60 is placed against the support 62 and wrapped or folded around the front end of the fingers 94. The flaps 74 are folded over the rounded edge portions 92. The flaps 74 are placed on the posts 86; the posts 86 extending through the holes 78. The front end 70 of the substrate is also placed on the posts 86; the posts 86 extending through the holes 72. Thus, the flaps 74 and front end 70 overlap each other at the posts 86. Referring also to FIG. 2, the second section 82 is then mounted onto the posts 86. The hinge 84 merely being bent to fold the second section 82 into a position over the first section 80. The lateral side projections 100 on the second section 82 fit between the front and rear projections 90, 91 on the first section 80. With the first and second sections 80, 82 attached to each other by the posts 86 and holes 98, portions of the flaps 74 and the front end 70 including the end edge 76 are sandwiched between the two sections 80, 82. This securely seats the flexible circuit 60 on the fingers 94. In alternate embodiments additional or alternative means could be used to attach the first and second sections to each other or attach the flexible circuit to the first section before the second section is mounted onto the first section. The side 63 of the flexible circuit 60, having the exposed conductors 66 thereon, is located such that the conductors 66 are at the outer side of the subassembly 14. The location E of the ends of the conductors 66 is located at one side of the fingers 94, but the conductors 66 do not wrap around the fingers 94. Thus, one outer side 102 of the assembly 14 at the front end has the conductors thereon and the opposite outer side 104 does not have the conductors.

Once the subassemblies 14 are assembled, they can easily be inserted into the housing 12 and spring members 18. Preferably, the spring members 18 are inserted into the housing 12 first. As the subassemblies 14 are inserted, the spring fingers 44 and spring sections 48 are deflected out of the path and exert a spring force to bias the subassemblies towards the separator wall 26. The lateral side spring sections 40 exert an alignment or centering force on the lateral sides of support 62 to center the subassemblies 14 in the housing 12. In addition, the inward extensions 42 on the spring sections 40 can latch behind the rear projections 91 to retain the subassemblies 14 inside the housing 12. As the subassemblies 14 are inserted into the housing 12, the side 63 of the flexible circuit 60 slides onto the top surfaces of the ridges 34 on the tails 32 of the contacts 16. More specifically, the exposed conductors 66 come into electrical contact with the ridges 34. The spring fingers 44 exert biasing forces against the side 104 to press the side 102 against the ridges 34. In this embodiment each conductor 66 has a respective finger 94 and spring finger 44. Thus, individual and separate biasing forces can be exerted on the conductors 66 by their respective fingers 94 and spring fingers 44 to insure good electrical contact between the conductors and the contacts 16. However, individual and separate biasing forces need not be provided.

The spring members 18 do not function as electrical connectors. Their spring function is separated from having to perform an electrical connection to the conductors 66. The spring members 18, because they surround the subassemblies 14, can also perform a shielding function. In alternate embodiments, other types of subassemblies, spring members, contacts or housings could be provided.

Figure 8:
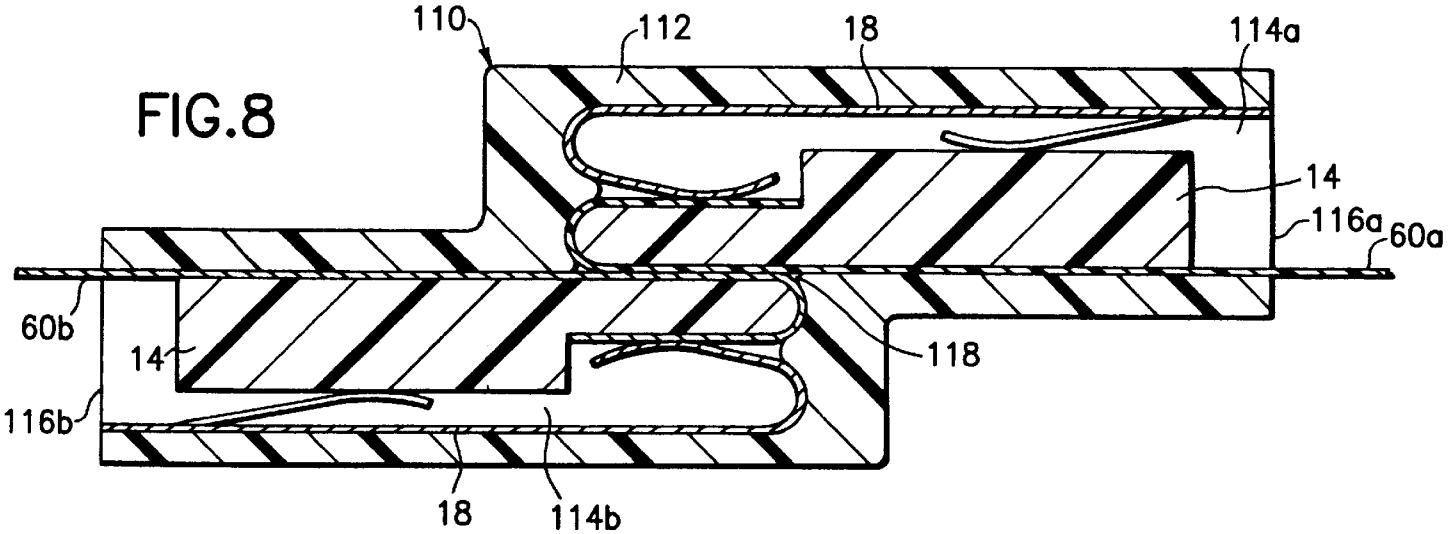
FIG. 8 is a cross-sectional view of an alternate embodiment of the present invention which connects two flexible circuits to each other.

Referring now to FIGS. 8–12 various different alternate embodiments will be described which use the subassemblies 14 and the spring members 18. The embodiment shown in FIG. 8 is generally intended to connect two flexible circuits to each other. The two flexible circuits 60*a*, 60*b* are part of two subassemblies 14. The connector 110 includes a housing 112 and two of the spring members 18. The housing 112 has two receiving areas 114*a*, 114*b* which have entrances 116*a*, 116*b* on opposite ends of the housing 112. The two receiving areas 114*a*, 114*b* are offset, but meet at an area 118. When the subassemblies 14 are inserted into the receiving areas 114*a*, 114*b* the spring member 18 bias the flexible circuits 60*a*, 60*b* against each other at the area 118 to electrically connect their conductors to each other.

Figure 9:
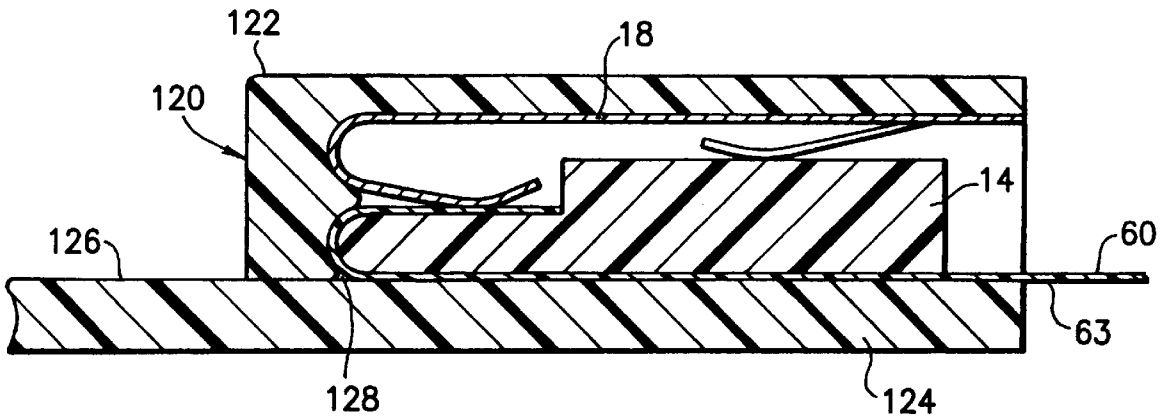
FIG. 9 is a cross-sectional view of an alternate embodiment of the present invention which connects a flexible circuit to a printed circuit board.

The connector 120 in FIG. 9 includes a housing 122, a spring member 18 and a subassembly 14. The connector 120 is used to connect the flexible circuit 60 to a printed circuit board 124. The housing 122 is fixed against a side 126 of the board 124 by suitable fasteners (not shown). The side 126 has contact pads. The housing 122 has an open side 128 which is placed against the side 126. When the subassembly 14 is inserted into the housing 122 the spring member 18 biases the subassembly 14 against the side 126 of the board 124. The conductors on the side 63 of the flexible circuit 60 are, thus, biased against the contact pads on the side 126 of the board 124.

Figure 10:
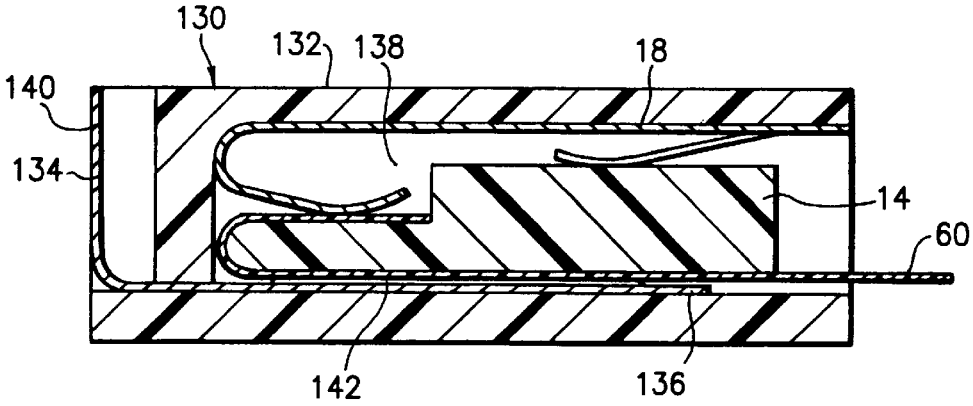
FIG. 10 is a cross-sectional view of an alternate embodiment of the present invention of an electrical connector and flexible circuit assembly having a solder tab.

The connector 130 shown in FIG. 10 generally comprises a housing 132, solder tabs 134 (only one of which is shown), a spring member 18 and a subassembly 14. The solder tabs 134 have ends 136 inside the receiving area 138 and ends 140 at an outer side of the housing 132. The ends 136 have raised areas 142. When the subassembly 14 is inserted into the receiving area 138 the side 63 is biased by the spring member 18 against the raised areas 142. This electrically connects the conductors on the side 63 to the solder tabs 134. The ends 140 can be soldered to another electronic component.

Figure 11:
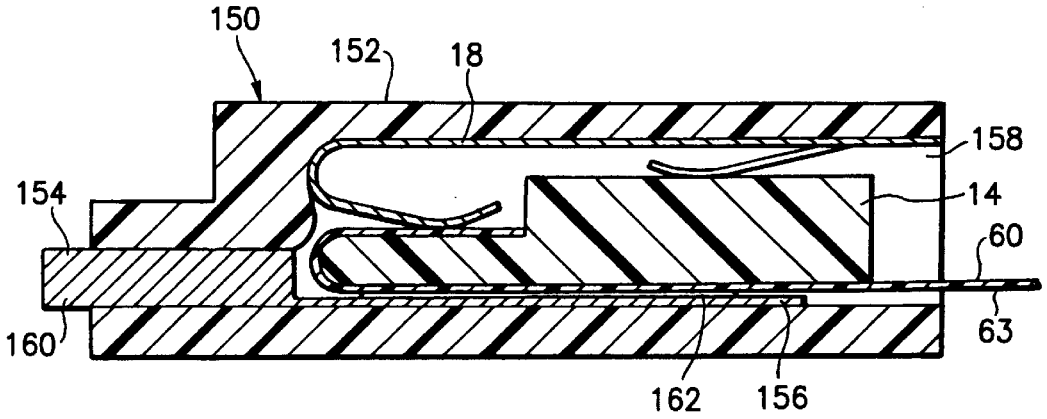
FIG. 11 is a cross-sectional view of an alternate embodiment of the present invention of an electrical connector and flexible circuit assembly having a solder pin.

The connector 150 shown in FIG. 11 generally comprises a housing 152, solder pins 154 (only one of which is shown), a subassembly 14 and a spring member 18. The solder pins 154 have ends 156 inside the receiving area 158 and ends 160 which project outward from the housing 152. The ends 156 in the receiving area 158 have raised areas 162 for making an electrical contact with the conductors on the side 63 of the flexible circuit 60. The ends 160 can be inserted into holes of another electronic component and soldered thereto.

Figure 12:
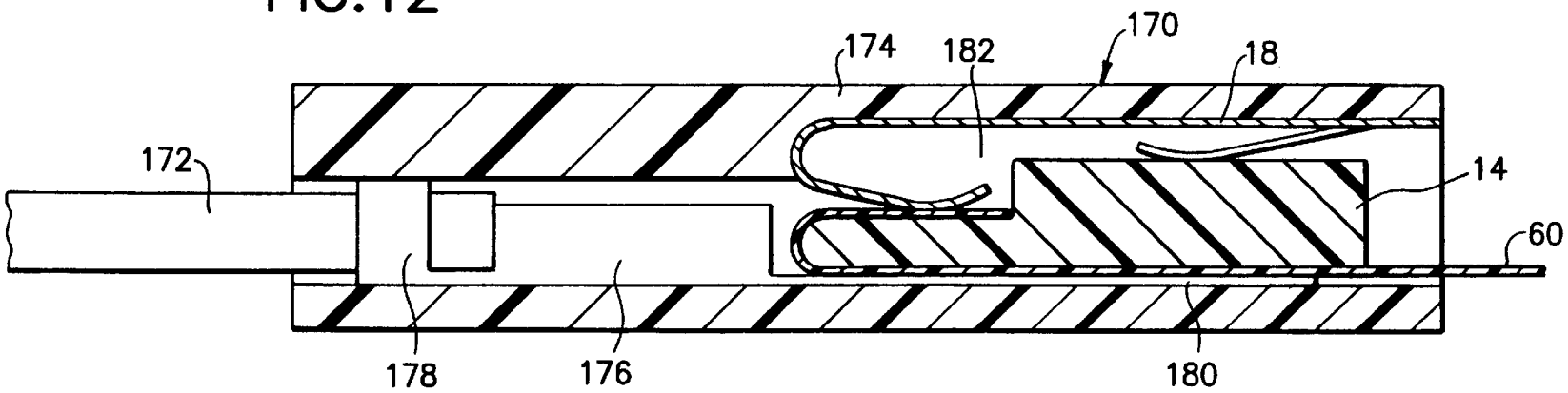
FIG. 12 is a cross-sectional view of an alternate embodiment of the present invention of an electrical connector and flexible circuit assembly having a wire crimp contact attached to a wire.

The connector 170 shown in FIG. 12 is for connecting electrical wires 172 to the flexible circuit 60. The connector 170 comprises a housing 174, the subassembly 14, and the spring member 18. The wires 172 have crimp terminals 176 connected thereto (only one of which is shown). The terminals 176 each have a section 178 which is electrically and mechanically crimped onto the wires 172. The terminals 176 each have a section 180 which project into the receiving area 182. The spring member 18 biases the subassembly 14 against the sections 180 of the terminals 176 to electrically connect the wires 172 to the conductors on the flexible circuit 60.

Figure 13:
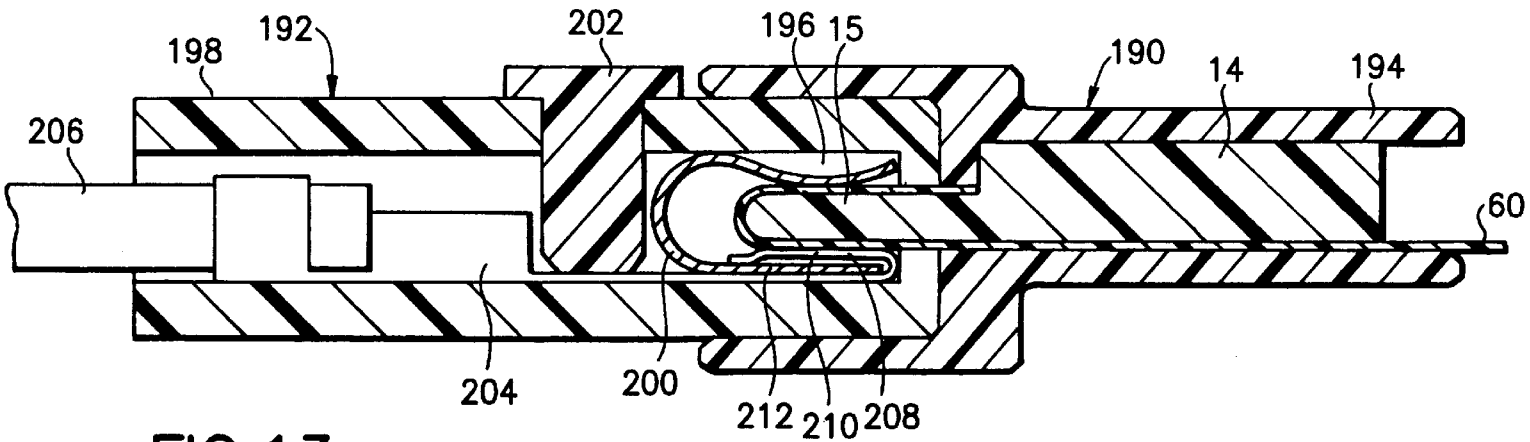
FIG. 13 is a cross-sectional view of an alternate embodiment of the present invention of an electrical connector and flexible circuit assembly attached to a female receptacle having a wire crimp contact and separate spring member.

Referring now to FIG. 13 another alternate embodiment is shown. In this embodiment a connector 190 is shown connected to a mating connector 192. The connector 190 comprises a housing 194 and a subassembly 14. The housing 194 has a mating connector receiving area 196. The front end 15 of the subassembly 14 projects into the receiving area 196. The mating connector 192 comprises a housing 198, a spring member 200, a terminal position assurance member 202, and crimp terminals 294 connected to electrical wires 206. The crimp terminals 204 have "U" shaped front ends 208 with sections 210 which can removably contact the conductors on the flexible circuit 60. A section 212 of the spring member 200 is received in the "U" shaped front ends 208. The spring member 200 has a general "U" shape and biases the front end 15 against the sections 210 of the terminals 204.

Figure 14:
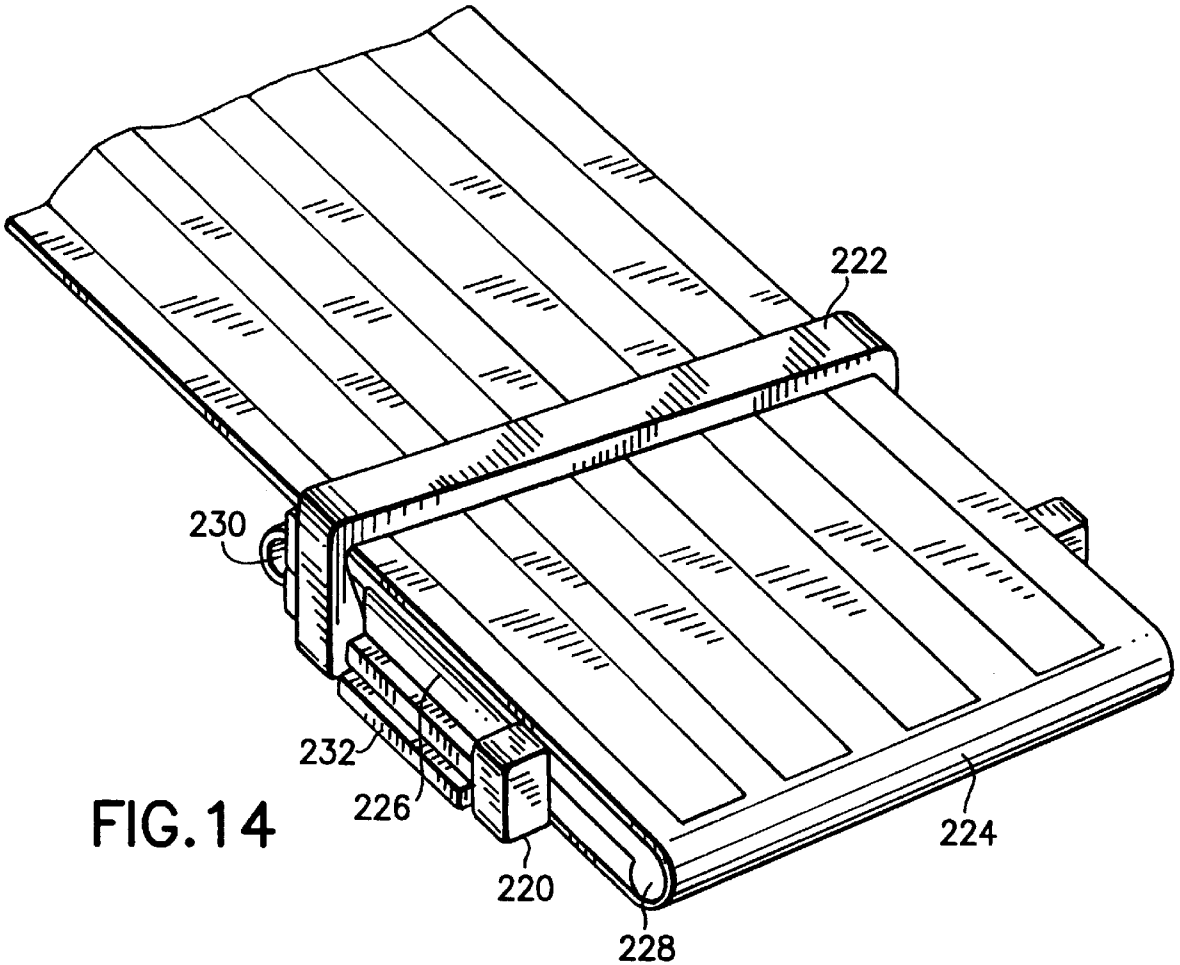
FIG. 14 is a perspective bottom view of an alternate embodiment of the flexible circuit support having the flexible circuit mounted thereto.

Referring now to FIG. 14, an alternate embodiment of the flexible circuit and rigidizer subassembly is shown. In this embodiment the rigidizer or support 220 is substantially the same as the support 62, but includes a bridge 222. In this embodiment the flexible circuit 224 does not include lateral flaps. The bridge 222 is part of the first section 226. The flexible circuit 224 is inserted through a gap or slot between the bridge 222 and the first section, wrapped around the front ends of the fingers 228 and mounted on posts of the first section. The hinge 230 is bent to mount the second section 232 onto the first section 226 and sandwiching the end of the flexible circuit 224 between the first and second section. Thus, features of the present invention can be used with flexible circuits that do not have lateral flaps. Features of the present invention could be used with any suitable type of flexible circuit and rigidizer subassembly.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

a housing;

a flexible circuit and rigidizer subassembly located in the housing; and a spring located in the housing and contacting a first side of the subassembly, wherein a second opposite side of the subassembly comprises an electrically conductive area, wherein the spring biases the subassembly in a direction of the second opposite side, and wherein the spring is not electrically connected to the electrically conductive area.

2. An electrical connector as in claim 1 further comprising at least one electrical contact located on the second side of the subassembly, wherein the spring biases the electrically conductive area against the contact.

3. An electrical connector as in claim 1 wherein the housing comprises an opening along the second side of the subassembly, wherein the housing can be placed against an electrical component with the electrically conductive area directly contacting the electrical component at the opening.

4. An electrical connector as in claim 1 further comprising a second spring and a second flexible circuit and rigidizer subassembly located in the housing.

5. An electrical connector as in claim 4 wherein the two subassemblies are biased by the springs directly against each other.

6. An electrical connector as in claim 1 wherein the spring comprises lateral side spring sections applying an alignment biasing force to lateral sides of the subassembly.

7. An electrical connector as in claim 1 wherein the spring comprises parallel spring fingers which are independently deflectable and which contact the first side of the subassembly at a front end of the subassembly.

8. An electrical connector as in claim 1 wherein the spring is comprised of electrically conductive metal and surrounds at least three sides of the subassembly in the housing to thereby form a shield for the subassembly.

9. An electrical connector comprising:

a housing;

a first flexible circuit and rigidizer subassembly located in the housing; and a first spring member located between the housing and the subassembly, the spring member contacting opposite lateral sides of the subassembly to thereby align the subassembly in the housing.

10. An electrical connector as in claim 9 wherein the spring member makes a locking engagement with the subassembly to retain the subassembly in the housing.

11. An electrical connector as in claim 9 wherein the spring member comprises spring fingers contacting a first side of the subassembly at a front end of the subassembly, and wherein the spring fingers are separately deflectable.

12. An electrical connector as in claim 9 wherein the spring member is comprised of electrically conductive metal and surrounds at least three sides of the subassembly.

13. An electrical connector as in claim 9 further comprising at least one contact, and wherein the spring member biases the subassembly against the at least one contact.

14. An electrical connector as in claim 9 wherein the housing comprises an opening along a second side of the subassembly, wherein the spring member biases the subassembly towards the opening, and wherein the second side of the subassembly comprises electrically conductive contact areas.

15. An electrical connector as in claim 9 further comprising a second flexible circuit and rigidizer subassembly and a second spring member, and wherein the subassemblies are located between the first and second spring members.

16. An electrical connector as in claim 15 wherein the first and second spring members substantially surround a portion of the first and second subassemblies.

17. An electrical connector as in claim 9 wherein the first flexible circuit and rigidizer subassembly comprises a first flexible circuit having signal conductor contact traces on a first side and a ground plane contact trace on an opposite second side.

18. An electrical connector comprising:

a housing;

a flexible circuit and rigidizer subassembly located in the housing; and a spring member located between the housing and the subassembly, the spring member being connected to the housing and comprising locking sections which contact opposite lateral sides of the subassembly to thereby retain the subassembly in the housing.

19. An electrical connector as in claim 18 wherein the locking sections apply a biasing force on the opposite lateral sides of the subassembly to center the subassembly relative to the spring member and thereby align the subassembly relative to the housing.

20. An electrical connector as in claim 18 wherein the spring member further comprises spring fingers contacting a first side of the subassembly to bias the subassembly in a direction away from the spring fingers.

21. An electrical connector as in claim 18 wherein the subassembly comprises electrically conductive areas on a second side of the subassembly which are not electrically connected to the spring member, the spring member contacting a first side of the subassembly and the two lateral sides.

22. An electrical connector as in claim 18 wherein flexible circuit and rigidizer subassembly comprises a first flexible circuit having signal conductor contact traces on a first side and a ground plane contact trace on an opposite second side.

* * * * *